US005941000A

United States Patent [19]

Sadow

[11] Patent Number: 5,941,000

[45] Date of Patent: Aug. 24, 1999

[54] EXTENSIBLE AND RETRACTABLE DISPLAY DEVICE FOR WHEELED LUGGAGE

[75] Inventor: Bernard David Sadow, Chappaqua, N.Y.

[73] Assignee: Outrigger, Inc., Chappaqua, N.Y.

[21] Appl. No.: 08/814,245

[22] Filed: Mar. 11, 1997

[51] Int. Cl.[6] ..... G09F 11/07

[52] U.S. Cl. ..... 40/529; 40/617

[58] Field of Search ..... 40/610, 601, 529, 40/617; 160/841.091; 190/115

[56] References Cited

U.S. PATENT DOCUMENTS

| | | | |
|---|---|---|---|
| 912,849 | 2/1909 | Hultgreen | 160/84.04 X |
| 4,588,055 | 5/1986 | Chen | 190/115 |
| 4,677,779 | 7/1987 | Rodriguez | 40/514 |
| 5,024,410 | 6/1991 | Ripley | 40/606 X |

FOREIGN PATENT DOCUMENTS

| | | | |
|---|---|---|---|
| 389099 | 8/1908 | France | 40/601 |
| 2269040 | 1/1984 | United Kingdom | 40/610 |

*Primary Examiner*—Cassandra H. Davis
*Attorney, Agent, or Firm*—Abelman, Frayne & Schwab

[57] ABSTRACT

An extensible and retractable display device for wheeled luggage comprises a plurality of panels which extend and retract upon extension and retraction, respectively, of the display device. The display device is attached to a telescoping handle for the luggage and retracts and extends along with the retraction and extension, respectively, of the telescoping handle.

12 Claims, 4 Drawing Sheets

EXTENSIBLE AND RETRACTABLE DISPLAY DEVICE FOR WHEELED LUGGAGE

BACKGROUND OF THE INVENTION

1. Field of the Invention

This invention relates to advertising particularly suitable for wheeled luggage with retractable handles of the type which permits the luggage to be rolled in various directions, and, more particularly, to an extensible and retractable display device attached to such wheeled luggage.

2. Description of the Related Art

There are many types of luggage, carry-on cases, and other bags currently sold with wheels attached to one of the panels of the item enabling it to be rolled on a surface, thereby saving the owner the exertion of carrying the item. To allow the owner to hold onto the item while it is rolling and to control the direction and speed of the item while it is rolling, the item will conventionally have an extensible and retractable support handle generally referred to as a telescoping support handle. For ease of grip and for maximum control by the user during rolling, these telescoping handles are conventionally U-shaped with two legs capable of telescoping relative to the item and a horizontal portion spanning between the legs and at the end of the legs nearest the owner for gripping by the owner, although other configurations are known.

Often the general profile of such luggage strongly resembles competitive luggage, and many of the desirable features which might tend to assist a purchaser in making a selection may not be immediately visible or may otherwise be difficult for the average potential consumer to discover without the assistance of a salesperson. For example, such items may have multiple interior compartments which will not be apparent unless the item is displayed in an open state. To the extent that the packaging of the luggage (i.e. its carton) may describe such features, the inventory of packaged product is often in a different area of the store and is only seen after the purchase is made. There thus exists a need for a convenient apparatus for apprising the consumer of a wheeled item's many features, preferably one which may be easily attached to and detached from a sample item, which is relatively inexpensive, does not require the need for additional display space, is affixed to the luggage so that if the luggage is moved, the display apparatus moves with it, and which may or may not, at the election of the retailer, be employed.

SUMMARY OF THE INVENTION

The invention comprises an extensible and retractable display device preferably attached to a telescoping handle of wheeled luggage. The display device is folded or otherwise has portions which when retracted will superimpose themselves upon next adjacent portions in response to the action of the retraction of the telescoping handle.

An object of the invention is to provide a means to allow a seller of wheeled luggage to conveniently inform potential purchasers of the features of the luggage.

A further object of the invention is to provide a means for informing potential purchasers about features of wheeled luggage which are not obvious upon cursory examination.

A still further object of the invention is to design the aforesaid means in such a manner that it may easily be attached to or detached from the wheeled luggage.

A yet further object of the invention is to design the aforesaid means such that it is easily visible and conspicuous to any potential purchaser of wheeled luggage.

These and other objects and advantages of the present invention will become more apparent to those of ordinary skill in the art upon consideration of the attached drawings and the following description of the preferred embodiments which are meant by way of illustration and example only, but are not to be construed as in any way limiting the invention disclosed and claimed herein.

DESCRIPTION OF THE PREFERRED EMBODIMENTS

For a more detailed description of the invention in its several embodiments, given only by way of example and not to be construed as limiting the invention in any fashion, we refer to the drawings.

Figure 1:
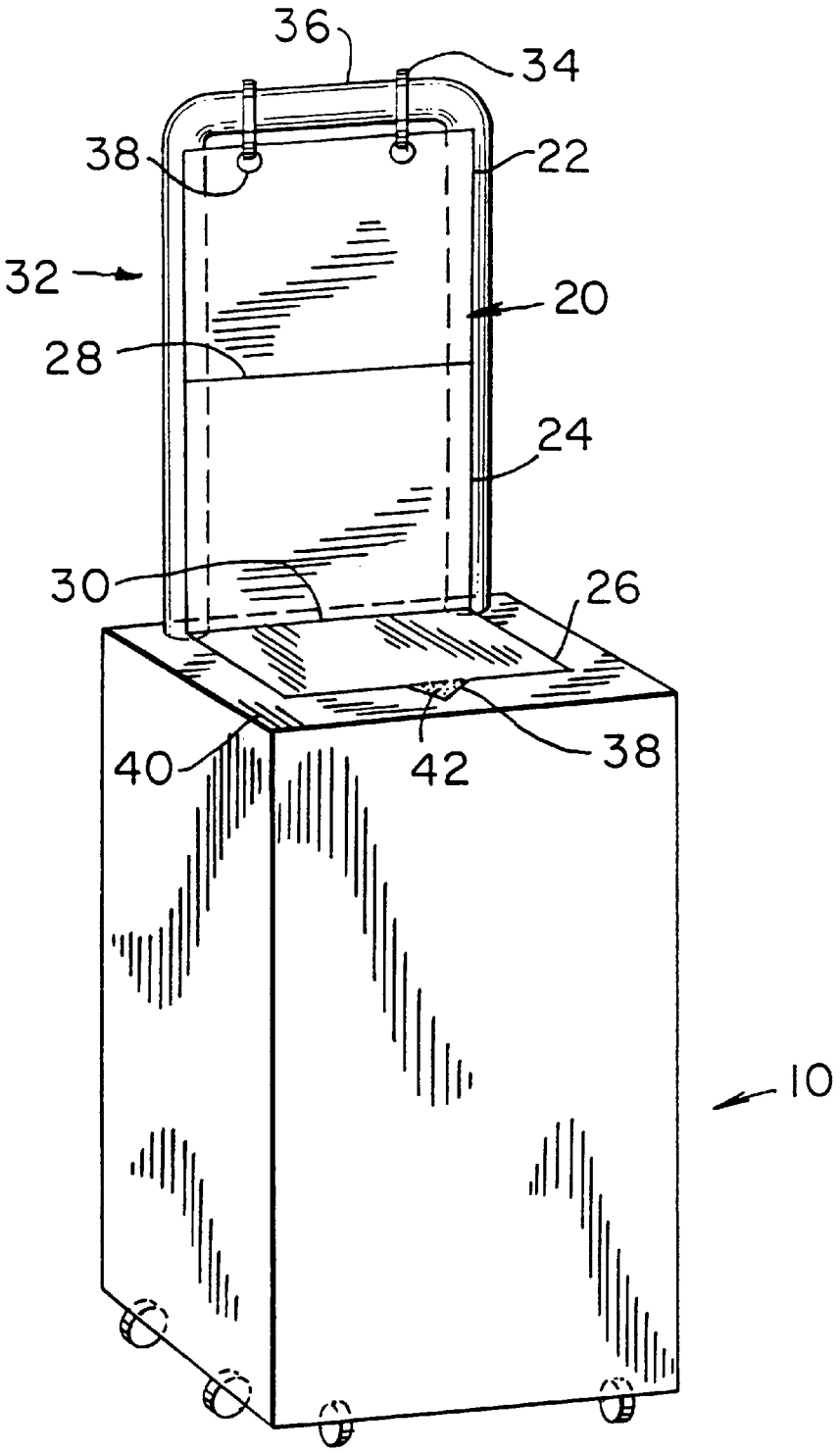
FIG. 1 is a perspective view of a piece of wheeled luggage and a first embodiment of the invention in a fully extended position.

In FIG. 1, a piece of wheeled luggage 10 of a generally parallelepiped shape is shown equipped with a folded extensible and retractable display device 20 in accordance with a first embodiment of the invention. The folded extensible and retractable display device 20 is shown in its fully extended position. In this fully extended position, the folded extensible and retractable display device 20 comprises an upper panel 22, a middle panel 24, and a lower panel 26. Upon retracting, the folded extensible and retractable display device 20 folds along a first fold line 28 between the upper panel 22 and the middle panel 24, and along a second fold line 30 between the middle panel 24 and the lower panel 26. The upper panel 22 is attached to a U-shaped telescoping handle 32 which is in turn attached to the wheeled luggage 10. The means of attachment of the upper panel 22 to the U-shaped telescoping handle 32 is preferably through a removable first attachment means, for example, rings 34 which are capable of snapping shut in a closed position around the horizontal portion 36 of the U-shaped telescoping handle 32. In such closed position, the rings 34 pass through apertures 38 found in the upper panel 22.

The upper panel 22 and the middle panel 24 will contain such advertisement of such features of the wheeled luggage 10 as the seller thinks desirable, but preferably will at 95 least contain those features which are not readily perceived by a potential consumer upon examination of the exterior of the wheeled luggage 10. The lower panel 26 may also optionally contain advertisement of the features of the wheeled luggage 10, but if such advertising is present, the middle panel 24 should preferably contain arrows or other text or graphics alerting a potential purchaser to the presence of additional advertising on the lower panel 26.

The lower panel 26 is attached to the wheeled luggage 10 by a second attachment means removable from the wheeled luggage 10. Such second attachment means, for example, can comprise an attachable and detachable triangular protrusion 38 integrally formed with the lower panel 26 located on the front of the top wall 40 of the wheeled luggage 10. The attachment and detachment of the triangular protrusion 38 be accomplished through, for example, the use of mating VELCRO surfaces 42 on the triangular protrusion 38 and the top wall 40.

In its fully retracted position, the folded extensible and retractable display device 20 forms a stack of its three panels; the upper panel 22 is on the top of the stack, the middle panel 24 is in the middle of the stack, and the lower panel 26 is on the bottom of the stack. First fold line 28 is above the lower panel 26. This fully retracted position occurs when the U-shaped telescoping handle 32 is also fully retracted. As will be readily conceived from a consideration of FIG. 2, the horizontal portion 36 of the U-shaped telescoping handle 32 will be higher than the folded extensible and retractable display device 20 when both are fully retracted. Thus, as long as the horizontal portion 36 of the U-shaped telescoping handle 32 fits into a luggage carton or other packaging when the U-shaped telescoping handle 32 attached to the folded extensible and retractable display device 20 is fully retracted, the folded extensible and retractable display device 20 will also fit in such carton or other packaging. Moreover, when a salesperson or consumer opens a carton or other packaging containing luggage with the folded extensible and retractable display device 20, the first thing seen by the salesperson or consumer is the folded extensible and retractable display device 20, assuming that the U-shaped telescoping handle 32 is immediately beneath the portion of the carton or other packaging opened.

Figure 2:
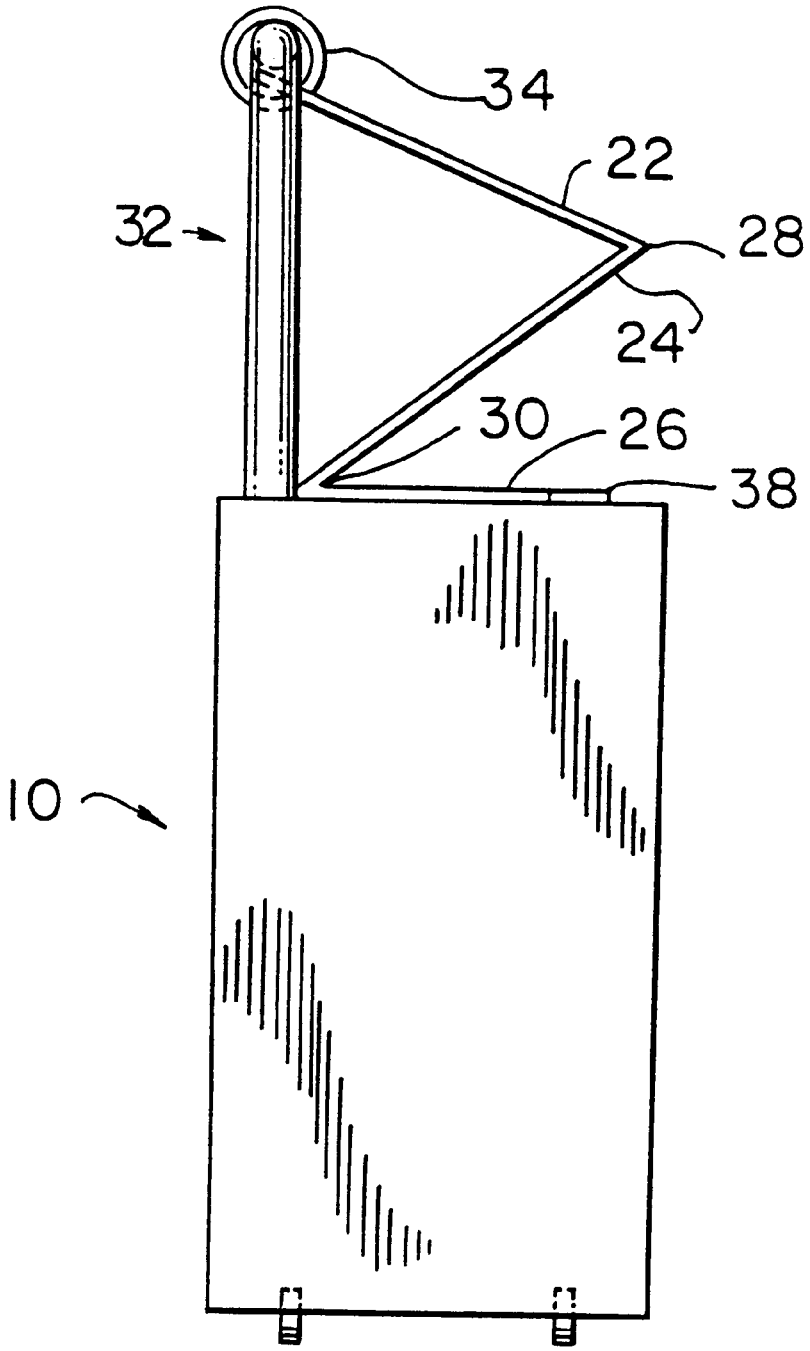
FIG. 2 is an elevation side view of the piece of wheeled luggage shown in FIG. 1 and the first embodiment of the invention in a partially extended position.

As the user extends the U-shaped telescoping handle 32, the folded extensible and retractable display device 20 also extends, unfolding as shown in FIG. 2 as it extends. This process of extension continues until the U-shaped telescoping handle 32 reaches its full extended length at which time the folded extensible and retractable display device 20 also reaches its full extended length as shown in FIG. 1.

Figure 3:
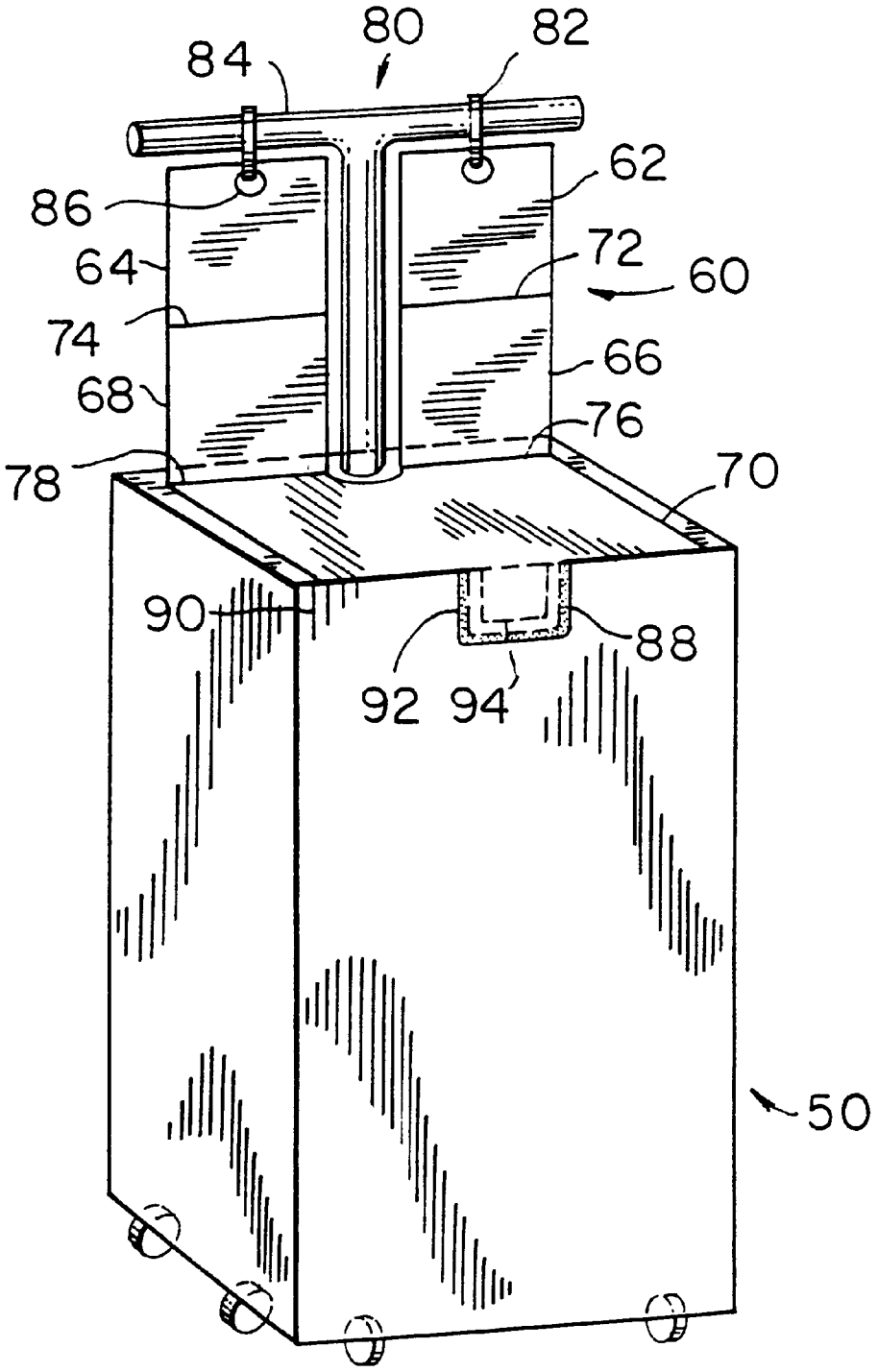
FIG. 3 is a perspective view of a piece of wheeled luggage and a second embodiment of the invention in a fully extended position.

In FIG. 3, a piece of wheeled luggage 50 of a generally parallelepiped shape is shown equipped with a folded extensible and retractable display device 60 in accordance with a second embodiment of the invention. The folded extensible and retractable display device 60 is shown in its fully extended position. In this fully extended position, the folded extensible and retractable display device 60 comprises a right upper panel 62, a left upper panel 64, a right middle panel 66, a left middle panel 68, and a lower panel 70. Upon retracting, the folded extensible and retractable display device 60 folds along a first fold line 72 between the right upper panel 62 and the right middle panel 66, along a second fold line 74 between the left upper panel 64 and the left middle panel 68, along a third fold line 76 between the right middle panel 66 and the lower panel 70, and along a fourth fold line 78 between the left middle panel 68 and the lower panel 70. The right upper panel 62 and the left upper panel 64 are attached to a T-shaped telescoping handle 80 which is in turn attached to the wheeled luggage 50. The means of attachment of the right upper panel 62 and the left upper panel 64 to the T-shaped telescoping handle 80 is preferably through a removable first attachment means, for example, rings 82 which are capable of snapping shut in a closed position around the horizontal portion 84 of the T-shaped telescoping handle 80. In such closed position, the rings 82 pass through apertures 86 found in the right upper panel 62 and the left upper panel 64.

The right upper panel 62, the left upper panel 64, the right middle panel 66, and the left middle panel 68 will contain such advertisement of such features of the wheeled luggage 50 as the seller thinks desirable, but preferably will at least contain those features which are not readily perceived by a potential consumer upon examination of the exterior of the wheeled luggage 50. The lower panel 70 may also optionally contain advertisement of the features of the wheeled luggage 50, but if such advertising is present, the right middle panel 66 and the left middle panel 68 should preferably contain arrows or other text or graphics alerting a potential purchaser to the presence of additional advertising on the lower panel 70.

The lower panel 70 is attached to the wheeled luggage 50 by a second attachment means removable from the wheeled luggage 50. Such second attachment means, for example, can comprise an attachable and detachable pocket 88 located an the top of the front wall 90 of the wheeled luggage 50. The attachment and detachment of the pocket 88 can be accomplished through, for example, the use of mating VELCRO surfaces 92 on the pocket 88 and the front wall 90. The pocket 88 is located on the front wall 90 and is of an appropriate size so that a tab 94, integrally formed as part of the lower panel 70, fits securely into the pocket 88, thus attaching the lower panel 70 to the wheeled luggage 50.

It should be noted that this arrangement for the second attachment means is only suitable for wheeled luggage 50 not requiring access to the area of the luggage covered by the second attachment means to discover features of the wheeled luggage 50 advertised by the folded extensible and retractable display device 60. If such access is required, the second attachment means shown in FIG. 1 or the like will be more suitable.

In its fully retracted position, the folded extensible and retractable display device 60 forms a stack of its five panels; the right upper panel 62 and the left upper panel 64 are on the top of the stack, the right middle panel 66 and the left middle panel 68 are in the middle of the stack, and the lower panel 70 is on the bottom of the stack. First fold lines 72, 74 are above the lower panel 70. This fully retracted position occurs when the T-shaped telescoping handle 80 is also fully retracted. Analogously to the conclusion reached regarding the U-shaped telescoping handle 32 from a consideration of FIG. 2, it can be seen that the horizontal portion 84 of the T-shaped telescoping handle 80 will be higher than the folded extensible and retractable display device 60 when both are fully retracted. Thus, as long as the horizontal portion 84 of the T-shaped telescoping handle 80 fits into a luggage carton or other packaging when the T-shaped telescoping handle 80 attached to the folded extensible and retractable display device 60 is fully retracted, the folded extensible and retractable display device 60 will also fit in such carton or other packaging. Moreover, when a salesperson or consumer opens a carton or other packaging containing luggage with the folded extensible and retractable display device 60, the first thing seen by the salesperson or consumer is the folded extensible and retractable display device 60, assuming that the T-shaped telescoping handle 80 is immediately beneath the portion of the carton or other packaging opened.

As the user extends the T-shaped telescoping handle 80, the folded extensible and retractable display device 60 also extends, unfolding as it extends. This process of extension continues until the T-shaped telescoping handle 80 reaches its full extended length at which time the folded extensible and retractable display device 60 also reaches its full extended length as shown in FIG. 3.

Figure 4:
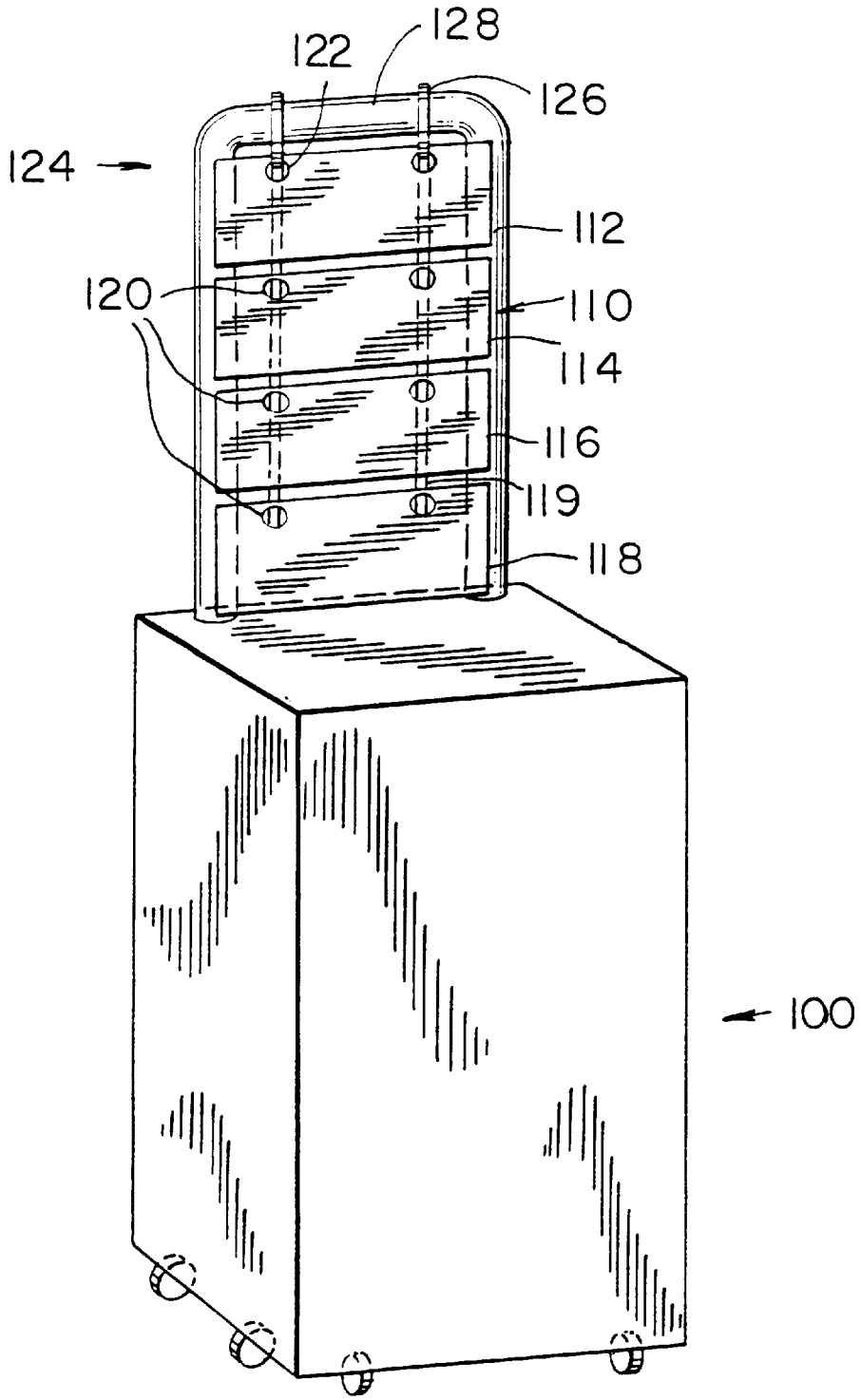
FIG. 4 is a perspective view of a piece of wheeled luggage and a third embodiment of the invention in a fully extended position.

In FIG. 4, a piece of wheeled luggage 100 of a generally parallelepiped shape is shown equipped with an extensible and retractable display device 110 in accordance with a third embodiment of the invention. The extensible and retractable display device 110 is shown in its fully extended position. In this fully extended position, the extensible and retractable display device 110 comprises an upper panel 112, an upper middle panel 114, a lower middle panel 116, and a lower panel 118. The upper panel 112, the upper middle panel 114, the lower middle panel 116, and the lower panel 118 are each separate from the at least one panel adjacent to them, but are connected by two cords 119 passing through apertures 120 in the lower panel 118, the lower middle panel 116, the upper middle panel 114, and apertures 122 in the upper panel 112. Upon retracting, the extensible and retractable display device 110 moves vertically downward so that the upper panel 112 superimposes itself upon the upper middle panel 114, the upper middle panel 114 superimposes itself upon the lower middle panel 116, and the lower middle panel 116 superimposes itself upon the lower panel 118. However, unlike the two preceding embodiments of the invention, the superimposing of a panel on the panel immediately below it occurs without the panels folding, and thus they remain in their vertical positions. The upper panel 112 is attached to a U-shaped telescoping handle 124 which is in turn attached to the wheeled luggage 100. The means of attachment of the upper panel 112 to the U-shaped telescoping handle 124 is through a removable first attachment means, for example, rings 126 which are capable of snapping shut in a closed position around the horizontal portion 128 of the U-shaped telescoping handle 124. In such closed position, the rings 126 pass through apertures 122 found in the upper panel 112.

The upper panel 112, the upper middle panel 114, the lower middle panel 116, and the lower panel 118 will contain such advertisement of such features of the wheeled luggage 100 as the seller thinks desirable, but preferably will at least contain those features which are not readily perceived by a potential consumer upon examination of the exterior of the wheeled luggage 100.

Since the superimposition of the panels on each other occurs with the panels not folding from the vertical position and since the upper panel 112 is attached to the U-shaped telescoping handle 124, the U-shaped telescoping handle 124 can initially only be retracted to a height capable of accommodating the height of the panel with the greatest height among the panels. In order to further retract the U-shaped telescoping handle 124, the panels can be removed from the U-shaped telescoping handle 124 by opening the rings 126 attaching the upper panel 112 to the horizontal portion 128 of the U-shaped telescoping handle 124. Alternatively, the user, with the use of his or her hands, can physically rotate the panels to a horizontal position as the U-shaped telescoping handle 124 is further retracted, even if the upper panel 112 remains attached to the horizontal portion 128 of the U-shaped telescoping handle 124 by the rings 126.

When it is desired to install and extend the extensible and retractable display device 110 on the piece of wheeled luggage 100, the U-shaped telescoping handle 124 can first be extended to a height capable of accommodating the height of the highest panel. The upper panel 112 can then be attached to the U-shaped telescoping handle 124 as previously described, and the U-shaped telescoping handle 124 may then be further extended, causing the extension of the extensible and retractable display device 110 to its fully extended position as shown in FIG. 4. Alternatively, the user can attach the upper panel 112 to the U-shaped telescoping handle 124 as previously described, even when the U-shaped telescoping handle 124 is fully retracted. The panels will then rotate to a vertical position as the U-shaped telescoping handle 124 is extended.

While preferred embodiments have been described herein, it will be understood by those with ordinary skin in the art that various modifications, changes, or alterations may be made to the invention disclosed and described wherein without departing from its scope or its equivalent as claimed in the appended claims.

For example, telescoping gripping means of a geometrical shape other than a U-shaped handle or a T-shaped handle may be used and still cause the extension and retraction of an extensible and retractable display device attached thereto.

Moreover, attachment means between the extensible and retractable display device and the telescoping handle may be through devices other than the rings described herein. Likewise, the triangular protrusion or pocket and tab arrangement attaching the lower panel of the folded extensible and retractable display device to the wheeled luggage is exemplary only and may be replaced by any equivalent attachment method well known in the art.

Furthermore, it may easily be conceived that the number of panels to be extended and retracted need not be limited to two or four, as disclosed in the three embodiments of the invention described above, but that such extending and retracting panels may be of any number greater than one.

Other modifications too numerous to mention will easily occur to one of ordinary skill in the art.

What is claimed is:

1. A combination of an item of wheeled luggage and a means for displaying information about said item of wheeled luggage, said item being of a generally parallelepiped shape, said item comprising a telescoping handle, said means comprising:

a. a plurality of panels, said information appearing on at least one of said plurality of panels;

b. a first attachment means for attaching a first end panel of said plurality of panels to said telescoping handle; and c. a second attachment means for attaching a second end panel of said plurality of panels to said item of wheeled luggage.

2. A combination of an item of wheeled luggage and a means for displaying information about said item of wheeled luggage as claimed in claim 1, wherein said plurality of panels are integrally formed into one sheet and each panel of said plurality of panels is separated from at least one other panel by at least one fold line.

3. A combination of an item of wheeled luggage and a means for displaying information about said item of wheeled luggage as claimed in claim 1, wherein said second end panel is adapted to rest on a wall of said item of wheeled luggage.

4. A combination of an item of wheeled luggage and a means for displaying information about said item of wheeled luggage as claimed in claim 1, wherein at least a portion of said first attachment means is removable from attachment to said first end panel and said telescoping handle.

5. A combination of an item of wheeled luggage and a means for displaying information about said item of wheeled luggage as claimed in claim 1, wherein said first attachment means comprises at least one ring and at least one aperture in said first end panel, said at least one ring enclosing said telescoping handle and passing through said at least one aperture.

6. A combination of an item of wheeled luggage and a means for displaying information about said item of wheeled luggage as claimed in claim 1, wherein at least a portion of said second attachment means is removable from attachment to said item of wheeled luggage.

7. A combination of an item of wheeled luggage and a means for displaying information about said item of wheeled luggage as claimed in claim 1, wherein said second attachment means comprises a protrusion integrally formed with said second end panel, said protrusion being removably attached to said item of wheeled luggage.

8. A method for displaying information about an item of wheeled luggage using a combination of an item of wheeled luggage and a means for displaying information about said item of wheeled luggage as claimed in claim 1, said method comprising the steps of:

a. attaching said first end panel of said plurality of panels to said telescoping handle by said first attachment means;

b. attaching said second end panel of said plurality of panels to said item of wheeled luggage by said second attachment means; and c. extending said telescoping handle, thereby extending said plurality of panels.

9. A combination of an item of wheeled luggage and a means for displaying information about said item of wheeled luggage as claimed in claim 1, wherein said second attachment means comprises a removable pocket attached to said item of wheeled luggage and a tab formed as a part of said second end panel, said tab fitting securely within said removable pocket.

10. A combination of an item of wheeled luggage and a means for displaying information about said item of wheeled luggage, said item being of a generally parallelepiped shape, said item comprising a telescoping handle, said means comprising:

a. a plurality of panels, said information appearing on at least one of said plurality of panels;

b. a first removable attachment means for attaching a first end panel of said plurality of panels to said telescoping handle; and c. a second attachment means for attaching each of said plurality of panels to at least one other of said plurality of panels.

11. A combination of an item of wheeled luggage and a means for displaying information about said item of wheeled luggage as claimed in claim 10, wherein said first removable attachment means comprises at least one removable ring and at least one aperture in said first end panel, said at least one removable ring being adapted to enclose said telescoping handle and being adapted to pass through said at least one aperture.

12. A method for displaying information about an item of wheeled luggage using a combination of an item of wheeled luggage and a means for displaying information about said item of wheeled luggage as claimed in claim 10, said method comprising the steps of:

a. attaching said first end panel of said plurality of panels to said telescoping handle by said first removable attachment means when said telescoping handle is extended to a height capable of accommodating any panel of said plurality of panels; and b. extending said telescoping handle, thereby extending said plurality of panels.

* * * * *